US008544855B2

(12) United States Patent
Shepley et al.

(10) Patent No.: US 8,544,855 B2
(45) Date of Patent: Oct. 1, 2013

(54) SKATE WITH INTERCHANGEABLE USE ELEMENTS

(76) Inventors: Robbie Shepley, Essex (CA); Kevin Bennett, Essex (CA); Bernard E. Coates, Belle River (CA); Thomas Congdon, Cottam (CA)

( * ) Notice: Subject to any disclaimer, the term of this patent is extended or adjusted under 35 U.S.C. 154(b) by 43 days.

(21) Appl. No.: 13/347,341

(22) Filed: Jan. 10, 2012

(65) Prior Publication Data

US 2013/0175771 A1 Jul. 11, 2013

(51) Int. Cl.
*A63C 1/00* (2006.01)

(52) U.S. Cl.
USPC ..... 280/11.3; 280/7.13; 280/11.221

(58) Field of Classification Search
USPC ..... 280/11.221, 11.27, 11.28, 11.3, 11.231, 280/11.12, 7.13, 613
See application file for complete search history.

(56) References Cited

U.S. PATENT DOCUMENTS

| | | | | |
|---|---|---|---|---|
| 32,173 | A | | 4/1861 | Bassford |
| 36,470 | A | | 9/1862 | Maydole |
| 83,756 | A | | 11/1868 | Brady |
| 462,279 | A | | 11/1891 | De Rohonczy |
| 779,417 | A | | 1/1905 | Finkle |
| 908,536 | A | | 1/1909 | Arlund |
| 1,820,302 | A | | 8/1931 | De Orlow |
| 1,991,855 | A | | 2/1935 | Johnson |
| RE19,706 | E | | 9/1935 | Johnson |
| 2,244,719 | A | | 6/1941 | Mansfield |
| 2,373,083 | A | | 4/1945 | Brewster |
| 3,026,118 | A | | 3/1962 | Pare |
| 4,132,424 | A | * | 1/1979 | Olivieri ..... 280/11.3 |
| 4,932,675 | A | | 6/1990 | Olson |
| 5,503,412 | A | | 4/1996 | Hill |
| 5,662,338 | A | | 9/1997 | Steinhauser, Jr. |
| 5,810,368 | A | | 9/1998 | Steinhauser, Jr. |
| 5,839,734 | A | | 11/1998 | Steinhauser, Jr. |
| 5,845,927 | A | | 12/1998 | Steinhauser, Jr. |
| 6,065,758 | A | | 5/2000 | Steinhauser, Jr. |
| 6,217,035 | B1 | | 4/2001 | Steinhauser, Jr. |
| 6,270,089 | B1 | | 8/2001 | Marechal |
| 6,334,621 | B1 | | 1/2002 | Chang |
| 6,364,321 | B1 | | 4/2002 | Steinhauser, Jr. |
| 6,623,017 | B1 | | 9/2003 | Steinhauser, Jr. |
| 6,648,346 | B2 | | 11/2003 | Borel |
| 6,702,304 | B2 | | 3/2004 | Chu |

(Continued)

FOREIGN PATENT DOCUMENTS

DE 202004002081 U 4/2004

OTHER PUBLICATIONS

ISR and Written Opinion for corresponding International PCT Application PCT/CA2013/000019, filed Jan. 10, 2013.

*Primary Examiner* — Hau Phan

(57) ABSTRACT

A skate having a detachable assembly comprising a use element selected from an ice skate blade, a roller skate assembly and an in-line roller skate assembly. The skate includes a shoe having a protrusion extending from the sole and into locking engagement with a corresponding socket in the detachable assembly. The protrusion including a cavity with a lateral recess which receives a corresponding engaging member of a coupling member disposed partially in the socket. The coupling member includes an actuating member selectively movable between a locking position where the engaging member is biased radially outwardly into engagement with the lateral recess, and a release position where the engaging member biased radially inwardly out of engagement with the lateral recess.

24 Claims, 6 Drawing Sheets

(56) References Cited

U.S. PATENT DOCUMENTS 6,729,629 B2 5/2004 Chi
6,736,411 B2 * 5/2004 Wang et al. ..... 280/7.13
6,742,788 B1 * 6/2004 Li et al. ..... 280/11.221
6,932,361 B2 8/2005 Steinhauser, Jr.

* cited by examiner

SKATE WITH INTERCHANGEABLE USE ELEMENTS

SCOPE OF THE INVENTION

The present invention relates, in general, to skates and more particularly to a skate having an interchangeable assembly which includes a use element selected from the group consisting of an ice skate blade, a roller skate assembly and an in-line roller skate assembly.

BACKGROUND OF THE INVENTION

Skates typically are dedicated to a single activity or sporting use, namely ice skates, roller skates or in-line roller skates. Generally, the assembly or tuck housing the ice skate blade or rollers is securely and permanently attached to the sole of a skate boot or shoe.

More recently, attempts have been made in providing interchangeable or convertible skates where skate boots have been provided with detachable assemblies which includes the ice blades, toe and heel roller or in-line roller assemblies. The use of such interchangeable skates provides the ability, in the case of ice skates and in-line roller skates, to easily switch between ice hockey and in-line roller skating without the need and expense associated with providing separate skates for each activity. Thus, for example, a hockey player using an interchangeable skate could use the same pair of skate boots or shoes with ice blades to play ice hockey and then, with the removal of the ice blades and the attachment of an in-line roller assembly to the same boot or shoe, use the skate for in-line roller skating. Such interchangeable skates also provide the user with an opportunity to have a second replacement set of ice blades, in-line roller assemblies, etc., for immediate use in the case of damage or dulling of the pair of blades or roller assemblies attached to the user's skate boots.

For example, as detailed in U.S. Pat. No. 5,839,734 to Steinhauser, Jr., although numerous convertible or replaceable skates have been previously proposed, the skate art still lacks a commercially viable interchangeable skate which is capable of supporting the high lateral torque forces exerted during skating. In this regard, Steinhauser proposes to remedy this deficiency by attaching an adapter plate having a central portion and depending peripheral sidewall forming a recessed cavity to a shoe body. The adapter plate detachably receives a complimentary shaped attachment plate forming a part of an interchangeable attachment. A plurality of different attachments, each having a distinct use, may be interchangeably mounted in the adapter plate. The adapter plate is fixedly connected to the sole of the shoe body or integrally molded as a unitary part of the shoe body to the sole of the shoe body. Fasteners mounted on the adapter plate releasably engage the attachment plate for releasably mounting the attachment to the shoe body.

However, the solution provided by Steinhauser, Jr. requires a number of separate actions to attach and detach the attachment plate, thereby rendering the attachment and detachment process time consuming. For example, each fastening means provided on the adapter plate has to be separately rotated about a pivoting point to secure the attachment plate to the adapter plate. Furthermore, each fastening means in Steinhauser, Jr is required to absorb not only the detachment forces acting to separate the attachment plate from the adapter plate, but also the high lateral torque forces exerted during skating, which could lead to pre-mature failure of the fastening means and therefore the failure of the skate for its intended purpose. For example, if the adaptor plate is integrally formed with the skate boot/shoe as taught in Steinhauser, Jr, the failure of one fastening means would result in the entire boot being inoperable to secure separate use elements, absent replacement of the failed fastening means.

Accordingly, there remains a need for a commercially viable interchangeable skate which meets the primary criteria of a quickly exchangeable use element, as for example blades or in-line roller assemblies, and more importantly, providing a rigid, secure attachment of the use element to the boot which does not exhibit any play or relative movement between the use element and the boot, and which can support both the axial/verticle separating forces acting to separate the use element from the skate boot, and the high lateral torque forces exerted during skating.

SUMMARY OF INVENTION

The present invention has been developed in view of the difficulties in the art noted and described above.

An objective of the present invention is to provide an interchangeable skate which having a quickly exchangeable attachment assembly securing a skating use element.

A further objective of the present invention is to provide an interchangeable skate which provides a rigid and secure connection between an attached assembly comprising a skating use element and a skate boot. The connection being cable to separately support both the axial/verticle separating forces acting to separate the attachment assembly from the skate boot, and the lateral torque forces exerted during skating In a first aspect, the present invention provides a skate comprising: a shoe having a sole comprising a bottom surface portion including at least one protrusion extending axially from the bottom surface portion to a distal end, each protrusion including at least one lateral recess; a detachable assembly comprising a support body and a use element, the support body comprising an upper surface portion for mating contact with the bottom surface portion when in an attachment position, and complementary sockets formed inwardly from the upper surface for receiving an associated one of the protrusions; and at least one coupling member for engaging at least one of said protrusions, each coupling member comprising a housing fixedly secured to the support body, the housing substantially supporting and retaining an engaging member; and a plunger axially displaceable relative to the housing between a locking position and a release position, wherein in said locking position the plunger biases the engaging member radially outwardly from said housing into engagement with said lateral recesses of the at least one of said protrusions when in said attachment position, and in said release position the at least one engaging member biases radially inwardly out of engagement with said lateral recesses of the at least one of said protrusions when in said attachment position.

In a further aspect of the invention, there is provided a skate which is capable of interchangeably receiving various use elements, each capable of a different skating use. Preferably the use element is selected from the group consisting of an ice skate blade, a roller skate assembly and an in-line roller skate assembly. The skate includes a shoe having a sole comprising a bottom surface portion including a protrusion extending along an axis from the bottom surface portion to a distal end, the protrusion including a cavity formed inwardly from the distal end and having at least one lateral recess; a detachable assembly comprising a support body and a use element, the support body comprising an upper surface portion for mating in juxtaposed contact the bottom surface portion when in an attachment position, and an associated socket formed inwardly from the upper surface for receiving in substantial registration the protrusion when in said attachment position; and a coupling member disposed partially in the associated socket and comprising a housing fixedly secured to the support body and having an upper end sized to be received in the cavity when in said attachment position, the upper end including at least one lateral through-hole; at least one engaging member being partially disposed in and selectively movable relative to the at least one through-hole; a plunger arranged in the housing and including at least one channel sized to receive at least a partial portion of the at least one engaging member, the plunger being axially displaceable relative to the housing between a locking position whereby when in said attachment position the plunger biases the at least one engaging member radially outwardly into engagement with portions of both the housing and the at least one lateral recess to substantially prevent the axial displacement of the protrusion relative to the associated socket, and a release position where the at least one channel is in substantial alignment with the at least one through-hole whereby when in said attachment position axial displacement of the protrusion relative to the associated socket biases the at least one engaging member radially inwardly out of engagement with the at least one lateral recess and at least partially into the at least one channel allowing for the axial displacement of the protrusion relative to the associated socket.

In a further aspect of the invention, the skate further comprises a biasing member for resiliently biasing the plunger towards the locking position.

In a further aspect of the invention, a first protrusion and said associated socket are located towards a toe end of the skate forward of an arch of a wearer's foot and a second protrusion and said associated socket are located towards a heel end of the skate rearward of the arch of the wearer's foot.

In a further aspect of the invention, the first and second protrusions are axially aligned along a longitudinal center of the skate.

In a further aspect of the invention, the protrusion comprises one of a polygonal cross-section or a circular cross-section having an outer surface tapering inwardly from the bottom surface portion.

In a further aspect of the invention, the protrusion comprises one of a cylindrical or pyramidal frustum shape tapering inwardly from the bottom surface portion.

In a further aspect of the invention, the cavity comprises a shape selected from one of a circular cross-section or a polygonal cross-section. Preferably the cavity comprises a plurality of substantially vertical side walls, each wall having an associated lateral recess.

In a further aspect of the invention, the lateral recess comprises a surface forming an acute angle with said axis to facilitate biasing of the engaging member radially inwardly out of engagement with said recess when axially displacing the protrusion relative to the socket.

In a further aspect of the invention, the channels comprise a surface forming an acute angle with said axis to facilitate biasing of the engaging member radially outwardly into engagement with said lateral recess.

In a further aspect of the invention, the housing is integrally formed with the support body.

In a further aspect of the invention, the engaging member is selected from one of a ball bearing, a resilient split ring, a resilient O-ring and a ball bearing ring.

In a further aspect of the invention, the through-hole comprises a conical shape tapering inwardly from said axis.

Further aspects of the invention will become apparent upon reading the following detailed description and drawings, which illustrate exemplary embodiments of this invention.

BRIEF DESCRIPTION OF THE DRAWINGS

Reference may now be had to the following detailed description taken together with the accompanying drawings in which.

DETAILED DESCRIPTION OF THE INVENTION

Figure 1:
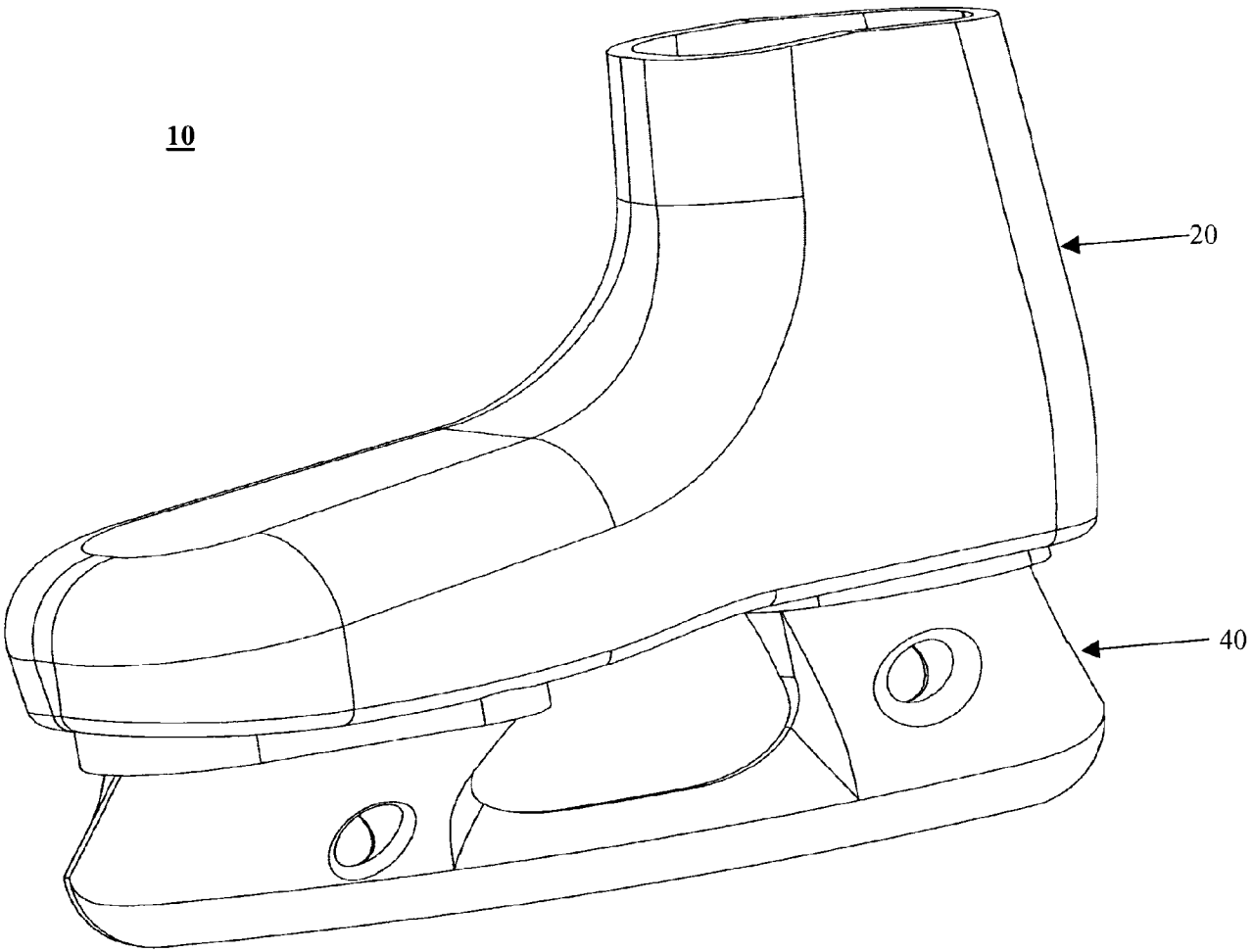
FIG. 1 shows a perspective view of an exemplary embodiment of an interchangeable ice skate in accordance with the present invention.
Figure 2:
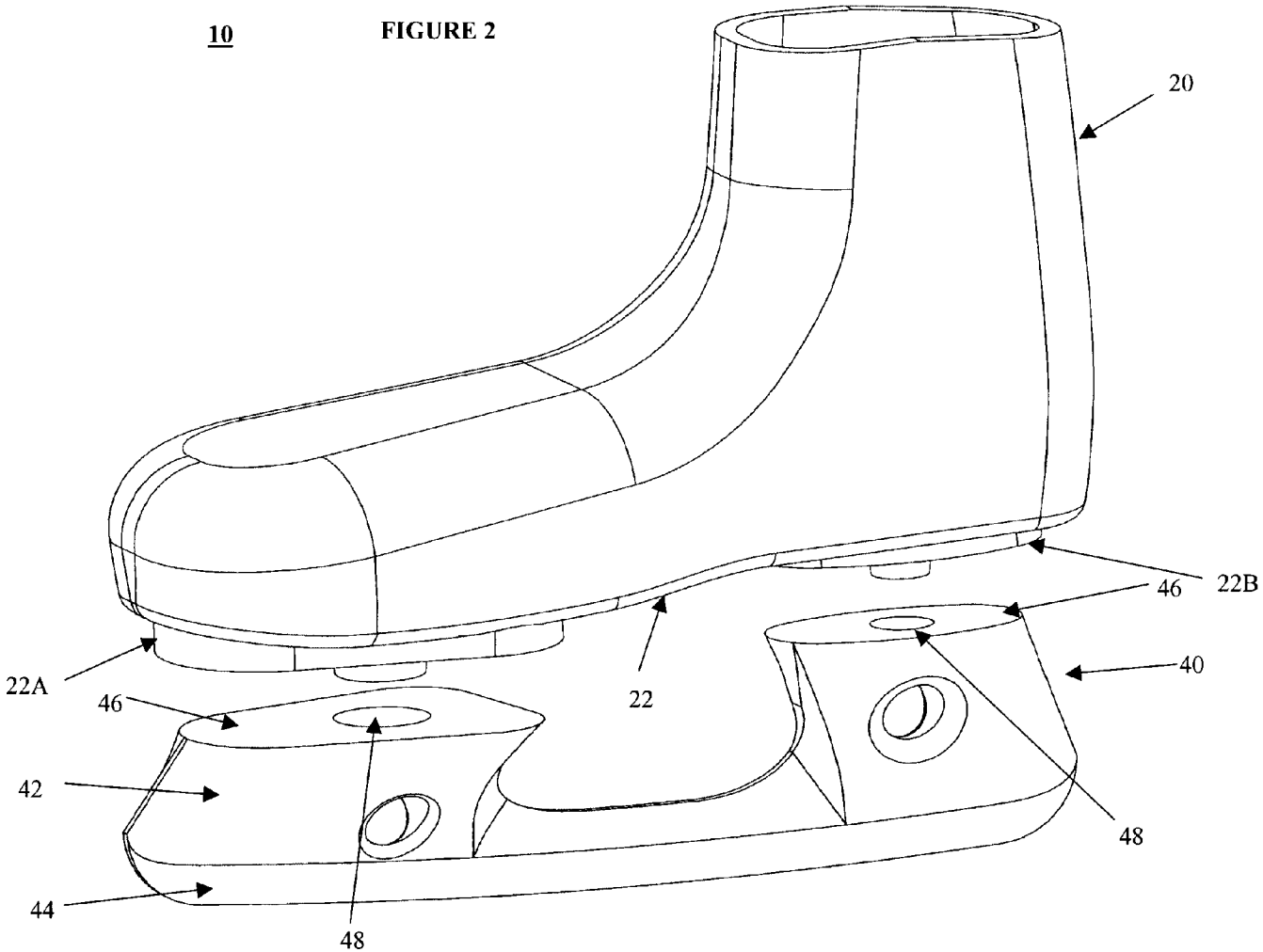
FIG. 2 shows an exploded perspective view of the ice skate shown in FIG. 1.
Figure 3:
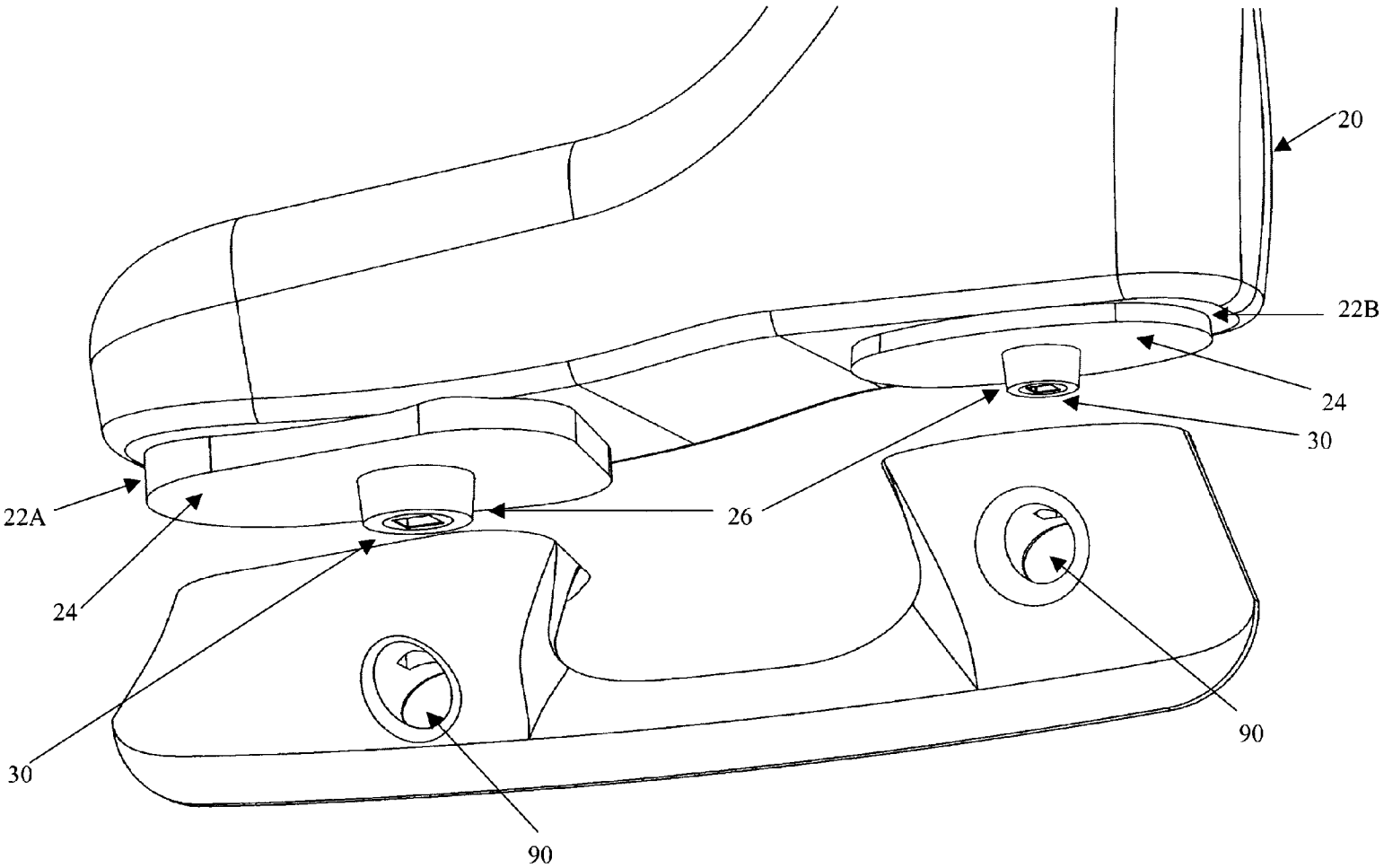
FIG. 3 shows another exploded perspective view of the ice skate shown in FIG. 1.
Figure 4:
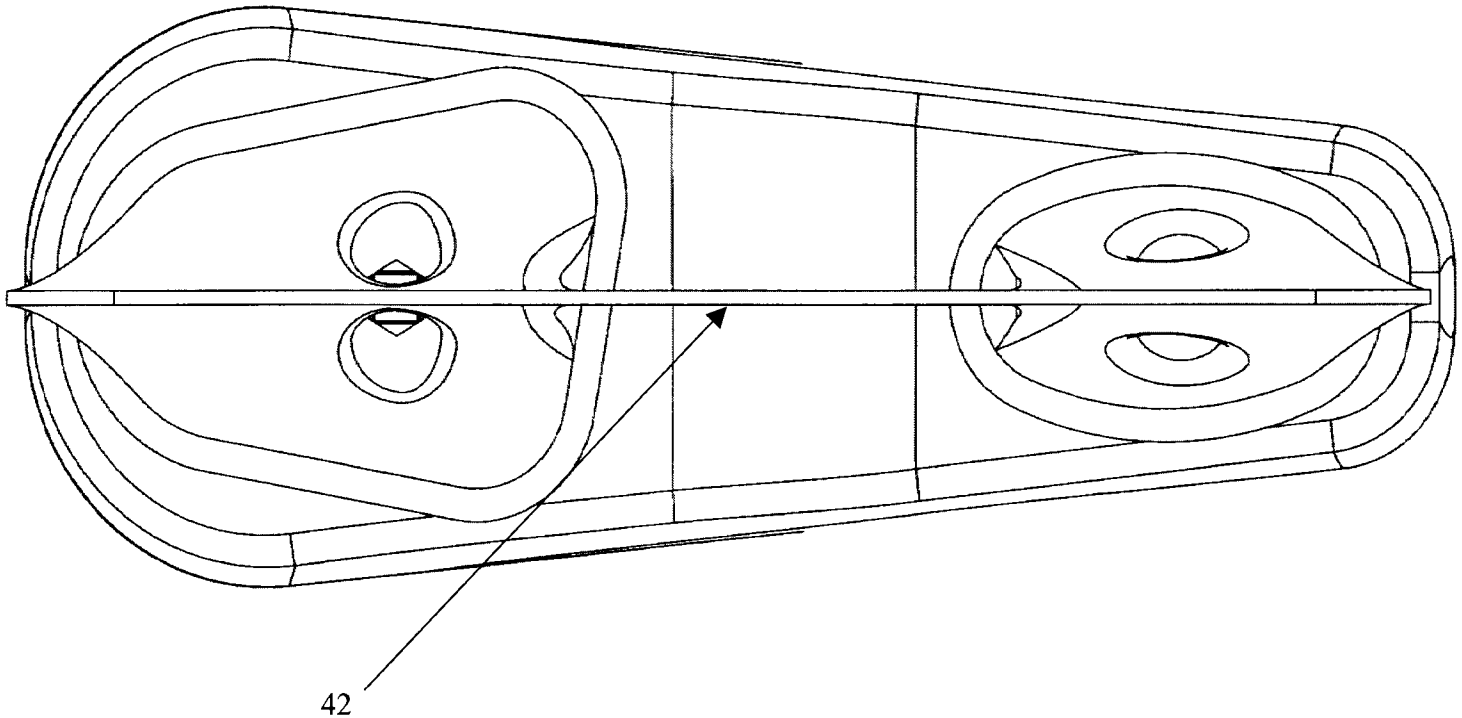
FIG. 4 shows a plan bottom view of the ice skate shown in FIG. 1.
Figure 5:
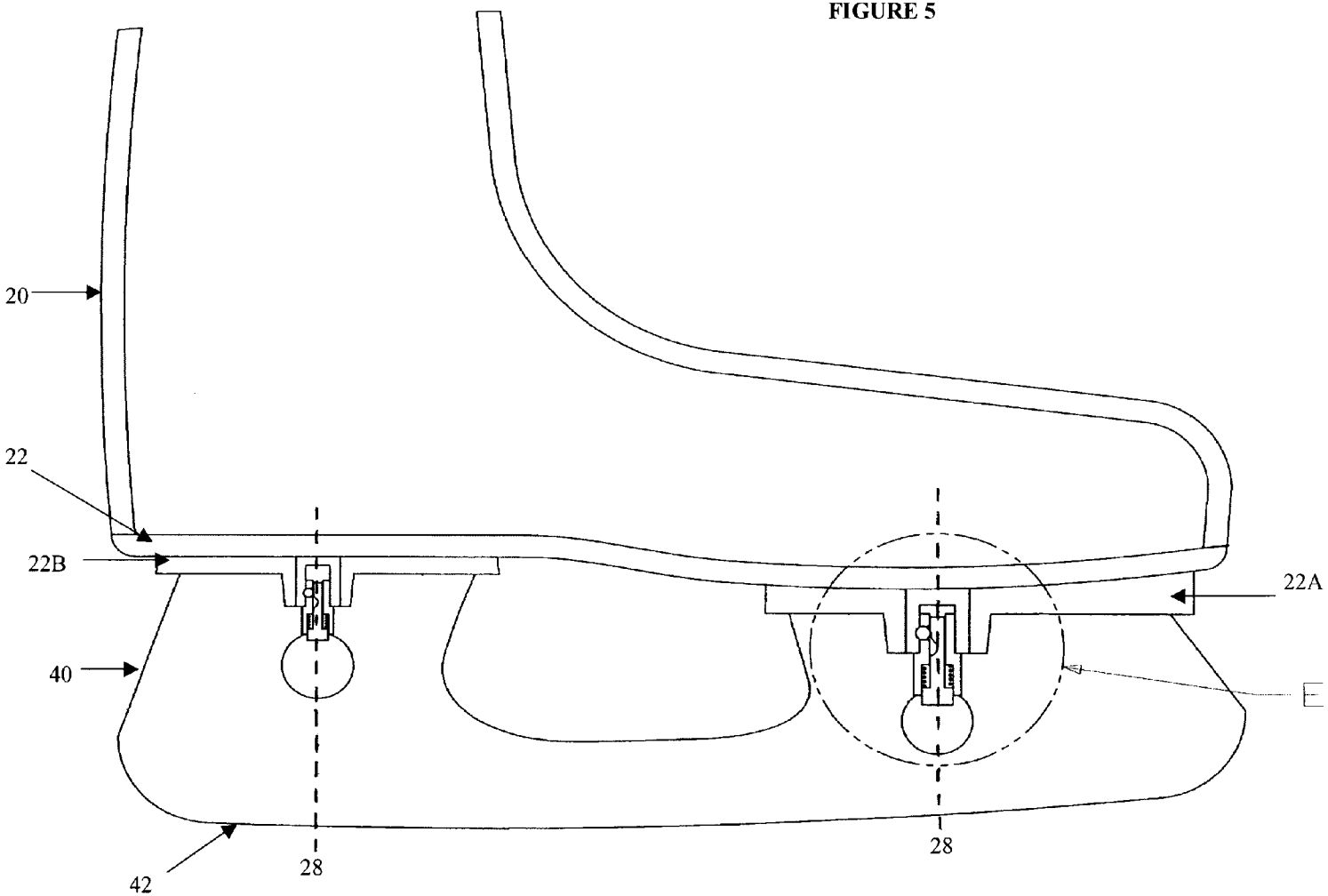
FIG. 5 shows a longitudinal cross-sectional view of the ice skate shown in FIG. 1 along the line A-A.

Reference may now be made to the various Figures illustrating a preferred embodiment of an ice skate in accordance with the present invention. The ice skate 10 includes a shoe/boot 20, a detachable assembly 40 and a coupling member 60.

The shoe 20 includes a sole 22 having formed therewith, a front toe end platform 22A and a rear heel end platform 22B. Each platform 22A and 22B include a bottom surface portion 24 having a generally cylindrical protrusion 26 extending from the bottom surface portion 24 to a distal end 30 along an axis 28. The front toe end platform 22A, rear heel end platform 22 B and protrusions 26 may be integrally molded with the sole 22 or may be independently formed and secured separately to the sole 22.

Preferably, an outer radial surface of the protrusion 26 tapers inwardly from the bottom surface portion 24 towards to the distal end 30. In a more preferred aspect of the invention, the protrusion includes a polygonal cross-section, as for example a rectangular or hexagonal cross section. More preferably the protrusion 26 is shaped like an inverted pyramidal frustum tapering inwardly from the bottom surface portion 24 to the distal end 30.

The protrusions 26 are received in complimentary corresponding sockets 48 provided in the detachable assembly 40. As will be more fully detailed below, the protrusions 26 and the corresponding sockets 48 function cooperatively as a wedge to absorb the lateral torque forces exerted during skating.

Figure 6:
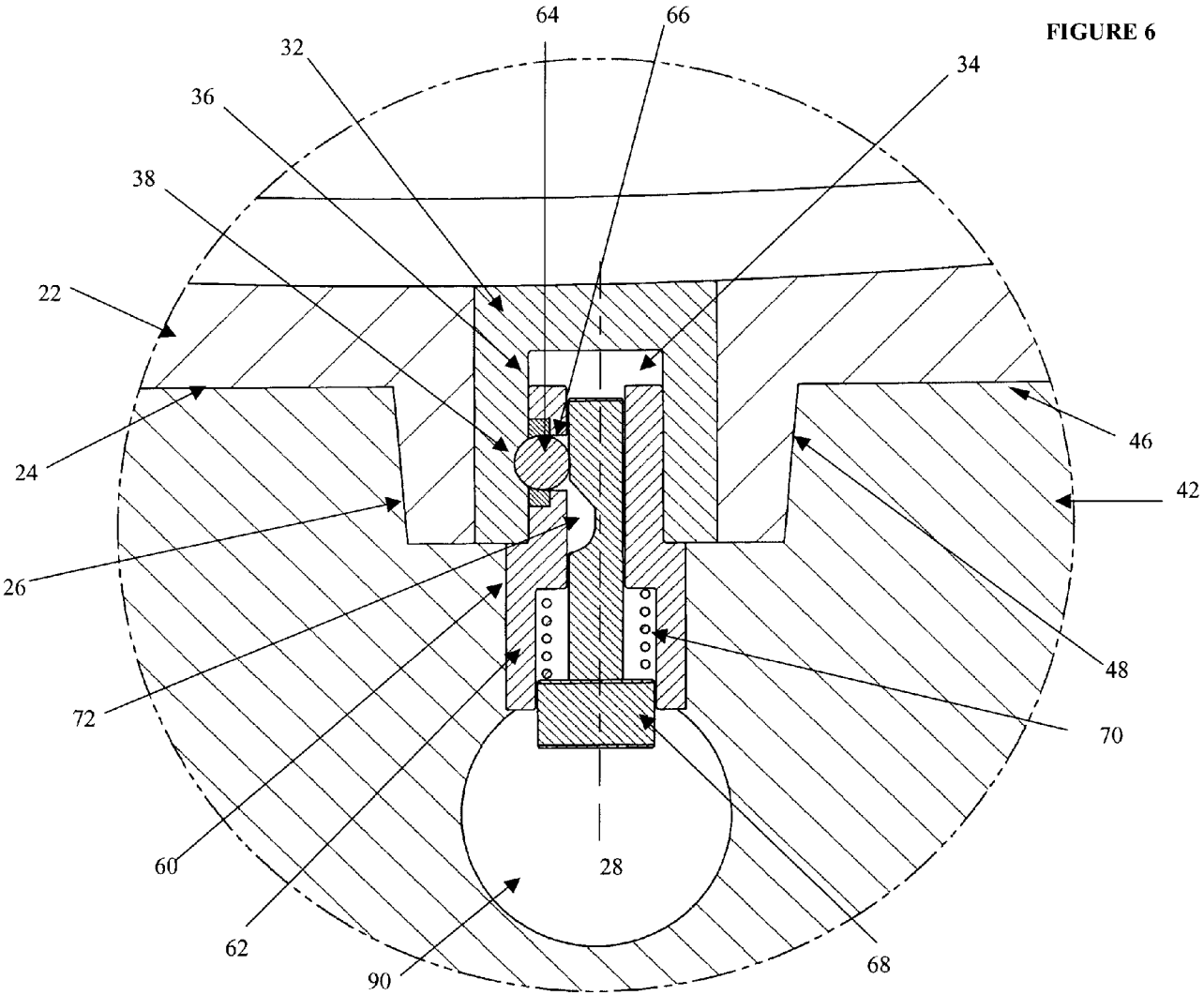
FIG. 6 shows an enlarged view of the section E shown in FIG. 5.

As shown in FIG. 6, the protrusion 26 includes an insert 32 having a recessed, rectangular cross-sectional shaped cavity 34 formed inwardly from the distal end 30. Preferably, the insert 32 and the protrusion 24 are integrally molded as a single unit. Preferably, the cross sectional shape of the cavity is circular or polygonal.

The cavity 34 includes four vertical side walls 36, with at least one of the walls 36 having a lateral recess 38 being formed therein. The lateral recess 38 is sized and configured to receive a corresponding engaging member 64 of the coupling member 60. As will be more fully detailed below, the lateral recess 38 and the corresponding engaging member 64 function cooperatively as a wedge absorbing the axial/vertical separating forces acting to separate the detachable assembly 40 from the skate shoe 20. Preferably, the lateral recess 38 includes a surface forming an acute angle with the axis to facilitate biasing of the engaging member 64 radially inwardly out of engagement with the recess 38 when an axial separating force is applied separating the protrusion 26 axially from the socket 48.

The detachable assembly 40 includes a support body 42 and a use element 44. The use element 44 is not particularly limiting, but preferred use elements 44 include ice skate blades, roller skate assemblies and an in-line roller blade skate assemblies.

The support body 42 includes an upper surface portion 46 for mating in juxtaposed contact the bottom surface portion 24 of the sole 22 when the detachable assembly 40 is attached to the shoe 20. The support body 42 also includes the sockets 48 formed inwardly from the upper surface 46 for receiving in substantial registration, the associated or corresponding protrusions 26 when the detachable assembly 40 is attached to the shoe 20.

Disposed partially within the socket 48 is the coupling member 60. The coupling member 60 includes a housing 62 which is fixedly secured to the support body 42. In a preferred aspect, the housing 62 may be integrally molded with the support body 42. An upper end of the housing 62 is sized to be received in the cavity 34 when the detachable assembly 40 is attached to the shoe 20. The upper end of the housing 62 includes a lateral through-hole 66 having partially disposed therein the engaging member 64, the engaging member 64 being selectively movable relative to the through-hole 66. Preferably the engaging member is a ball bearing, a resilient split ring/C-ring, and a resilient O-ring or a ball bearing ring.

Arranged within the housing 62 there is provided a plunger 68 and a spring 70 for resiliently biasing the plunger away from the shoe 20 and into a locking position.

The plunger 68 includes a lower end which is accessible by a user through an aperture 90 provided through the support body 42. The plunger 68 also includes a channel 72 sized to receive, at least partially therein, a portion of the engaging member 64. In operation, the plunger 68 is axially displaceable, relative to the housing 62 between the locking position and a release position. In the locking position, when the detachable assembly 40 is attached to the shoe 20, an outer surface of the plunger 68 restricts the radially inward movement of the engaging member 64 relative to the through-hole 66. Accordingly, the engaging member 64 is thereby biased radially outwardly of the housing 62 into locking engagement with portions of both the housing 62 and the lateral recess 38 to substantially prevent the axial displacement of the protrusion 26 relative to the socket 48. Similarly, in the release position, when the detachable assembly 40 is attached to the shoe 20, the plunger 68 is axially displaced so that the channel 72 is in substantial alignment with the through-hole 66. When an axial separating force is applied, the displacement of the protrusion 26 relative to the socket 48 provides an inwardly biasing force, biasing the engaging member 64 radially inwardly out of engagement with the lateral recess 38 and at least partially into the channel 72 allowing for the axial displacement of the protrusion 26 relative to the associated socket 48.

It will be understood that, although various features of the invention have been described with respect to one or another of the embodiments of the invention, the various features and embodiments of the invention may be combined or used in conjunction with other features and embodiments of the invention as described and illustrated herein.

For example, the plunger 68 functions to bias the engaging member 64 radially inwardly and outwardly into locking and release positions. It is to be understood that an axially rotatable plunger having an oval cross-section would be equally applicable to the present invention where a resiliently biased split ring/C-ring provided about the rotatable plunger is expanded outwardly and/or inwardly by rotation of the plunger. Similarly, an axially displaceable plunger and a resiliently biased O-ring would be equally applicable to the present invention where a central aperture of the O-ring receives an end of a plunger thicker then the aperture to expand the O-ring outwardly, and where removal of the plunger from the aperture in the O-ring returns the O-ring to its original diameter.

To the extent that a patentee may act as its own lexicographer under applicable law, it is hereby further directed that all words appearing in the claims section, except for the above defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate, ordinary, plain and accustomed meanings (as generally evidenced, inter alia, by dictionaries and/or technical lexicons), in the situation where a word or term used in the claims has more than one pre-established meaning and the specification is helpful in choosing between the alternatives.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

We claim:

1. A skate comprising:

a shoe having a sole comprising a bottom surface portion including a protrusion extending along a longitudinal axis from the bottom surface portion to a distal end of the protrusion, the protrusion including a cavity formed inwardly from the distal end and having at least one lateral recess;

a detachable assembly comprising a support body and a use element, the support body comprising an upper surface portion for mating in juxtaposed contact the bottom surface portion when in an attachment position, and an associated socket formed inwardly from the upper surface for receiving in registration the protrusion when in said attachment position; and a coupling member disposed partially in the associated socket and comprising a housing fixedly secured to the support body and having an upper end sized to be received in the cavity when in said attachment position, the upper end including at least one lateral through-hole;

at least one engaging member being partially disposed in and selectively movable relative to the at least one through-hole;

a plunger arranged in the housing and including at least one channel sized to receive at least a partial portion of the at least one engaging member, the plunger being axially displaceable relative to the housing between a locking position whereby when in said attachment position the plunger biases the at least one engaging member radially outwardly into engagement with portions of both the housing and the at least one lateral recess to prevent the axial displacement of the protrusion relative to the associated socket, and a release position where the at least one channel is in substantial alignment with the at least one through-hole whereby when in said attachment position axial displacement of the protrusion relative to the associated socket biases the at least one engaging member radially inwardly out of engagement with the at least one lateral recess and at least partially into the at least one channel allowing for the axial displacement of the protrusion relative to the associated socket.

2. The skate according to claims 1, further comprising a biasing member for resiliently biasing the plunger towards the locking position.

3. The skate according to claim 1, wherein the use element is selected from the group consisting of an ice skate blade, a roller skate assembly and an in-line roller skate assembly.

4. The skate according to claim 1, wherein a first protrusion and said associated socket are located towards a toe end of the skate forward of an arch of a wearer's foot and a second protrusion and said associated socket are located towards a heel end of the skate rearward of the arch of the wearer's foot.

5. The skate according to claim 4, wherein the first and second protrusions are axially aligned along a longitudinal center of the skate.

6. The skate according to claim 1, wherein the protrusion comprises one of a polygonal cross-section or a circular cross-section having an outer surface tapering inwardly from the bottom surface portion.

7. The skate according to claim 1, wherein the protrusion comprises one of a cylindrical or pyramidal frustum shape tapering inwardly from the bottom surface portion.

8. The skate according to claim 1, wherein the cavity comprises a shape selected from one of a circular cross-section or a polygonal cross-section.

9. The skate according to claim 1, wherein the cavity comprise a plurality of substantially vertical side walls, each wall having an associated lateral recess.

10. The skate according to claim 1, wherein the protrusion is integrally formed with the sole.

11. The skate according to claim 1, wherein the lateral recess comprises a surface forming an acute angle with said axis to facilitate biasing of the engaging member radially inwardly out of engagement with said recess when axially displacing the protrusion relative to the socket.

12. The skate according to claim 1, wherein said channels comprise a surface forming an acute angle with said axis to facilitate biasing of the engaging member radially outwardly into engagement with said lateral recess.

13. The skate according to claim 1, wherein the housing is integrally formed with the support body.

14. The skate according to claim 1, wherein the engaging member is selected from one of a ball bearing, a resilient split ring and a ball bearing ring.

15. The skate according to claim 1, wherein the through-hole comprises a conical shape tapering inwardly from said axis.

16. A skate comprising:

a shoe having a sole comprising a bottom surface portion including at least one protrusion extending axially from the bottom surface portion to a distal end of the protrusion, each protrusion including at least one lateral recess;

a detachable assembly comprising a support body and a use element, the support body comprising an upper surface portion for mating contact with the bottom surface portion when in an attachment position, and complementary sockets formed inwardly from the upper surface for receiving an associated one of the protrusions; and at least one coupling member for engaging at least one of said protrusions, each coupling member comprising a housing fixedly secured to the support body, the housing substantially supporting and retaining an engaging member; and a plunger axially displaceable relative to the housing between a locking position and a release position, wherein in said locking position the plunger biases the engaging member radially outwardly from said housing into engagement with said lateral recesses of the at least one of said protrusions when in said attachment position, and in said release position the at least one engaging member biases radially inwardly out of engagement with said lateral recesses of the at least one of said protrusions when in said attachment position.

17. The skate according to claims 16, further comprising a biasing member for resiliently biasing the plunger towards the locking position.

18. The skate according to claim 16, wherein the use element is selected from the group consisting of an ice skate blade, a roller skate assembly and an in-line roller skate assembly.

19. The skate according to claim 16, wherein at least two of said protrusions and an associated first of the coupling members are located towards a toe end of the skate forward of an arch of a wearer's foot and at least another two of said protrusions and an associated second of the coupling members are located towards a heel end of the skate rearward of the arch of the wearer's foot.

20. The skate according to claim 19, wherein the first and second associated coupling members are axially aligned along a longitudinal center of the skate.

21. The skate according to claim 16, wherein the at least one protrusion comprises a shape selected from one of a cylindrical cross-section, a polygonal cross-section and a frustum wedge.

22. The skate according to claim 16, wherein the protrusion is integrally formed with the sole.

23. The skate according to claim 16, wherein the housing is integrally formed with the support body.

24. The skate according to claim 16, wherein the engaging member is selected from one of a ball bearing, a resilient split ring and a ball bearing ring.

* * * * *